US008425338B2

(12) United States Patent
Gray

(10) Patent No.: US 8,425,338 B2
(45) Date of Patent: Apr. 23, 2013

(54) INFLATABLE SEALED AIR SUPPORT DEVICE

(75) Inventor: Stephen Gray, Glendora, CA (US)

(73) Assignee: Inflatable 2000, Inc., Azusa, CA (US)

( * ) Notice: Subject to any disclaimer, the term of this patent is extended or adjusted under 35 U.S.C. 154(b) by 280 days.

(21) Appl. No.: 12/948,762

(22) Filed: Nov. 17, 2010

(65) Prior Publication Data

US 2012/0129618 A1 May 24, 2012

(51) Int. Cl.
*A63G 31/12* (2006.01)
*A63B 9/00* (2006.01)

(52) U.S. Cl.
USPC ..... 472/134; 482/35; 52/2.22

(58) Field of Classification Search ..... 472/134, 472/135, 136; 482/34, 35, 36, 37, 38; 52/2.17, 52/2.18, 2.22, 2.23
See application file for complete search history.

(56) References Cited

U.S. PATENT DOCUMENTS 5,247,768 A * 9/1993 Russo ..... 52/2.13
5,462,505 A * 10/1995 Blair et al. ..... 482/27
5,678,357 A * 10/1997 Rubio et al. ..... 52/2.17
5,761,852 A * 6/1998 Liu ..... 52/2.18
5,865,693 A * 2/1999 Johnson ..... 473/478
6,764,408 B1 * 7/2004 Coleman ..... 472/134
7,335,109 B2 * 2/2008 Chen ..... 472/134
7,611,148 B2 * 11/2009 Caswell ..... 273/400

* cited by examiner

*Primary Examiner* — Kien Nguyen
(74) *Attorney, Agent, or Firm* — Cotman IP Law Group, PLC

(57) ABSTRACT

A sealed air support structure including at least one sealed air chamber. The at least one sealed air chamber includes at least a first side support and a second side support, each having a support end and a base end. The at least one sealed air chamber includes a main beam with a first end coupled with the support end of the first side support and a second end coupled with the support end of the second side support. A first plurality of connectors coupled with the base end of the first side support and a second plurality of connectors coupled with the base end of the second side support are configured to detachably couple with a plurality of connectors disposed on a cold-air inflatable structure. The at least one sealed air chamber is configured to support a weight applied to the main beam.

20 Claims, 7 Drawing Sheets

INFLATABLE SEALED AIR SUPPORT DEVICE

BACKGROUND OF THE INVENTION

1. Field of the Invention

Embodiments of the invention described herein pertain to the field of inflatable structures. More particularly, but not by way of limitation, one or more embodiments of the invention enable an inflatable sealed air support device.

2. Description of the Related Art

Cold-air inflatable structures are often used in for entertainment purposes, particularly for children's activities. An inflatable blower is used to maintain inflation in the cold-air inflatable structure, which typically has unsealed seams. The constant flow of air into the inflatable structure maintains the inflated state of the structure.

Due to the construction of cold-air inflatable structures, raised portions of cold-air inflatable structures typically cannot support substantial weight, such as the weight of a person. The application of any substantial force typically results in the deflation of the cold-air inflatable structure.

Although a base of a cold-air inflatable structure may be constructed to support substantial weight, such as the weight of a person, cold-air inflatable structures typically do not have raised portions which are capable of handling the application of force. This nature of the cold-air inflatable structure limits the versatility of cold-air inflatable structures.

To overcome the problems and limitations described above there is a need for an inflatable sealed air support device to provide weight-bearing support structures in cold-air inflatable structure.

BRIEF SUMMARY OF THE INVENTION

One or more embodiments of the invention enable a sealed air support structure. The sealed air support structure includes at least one sealed air chamber including at least one sealed seam. In one or more embodiments, the at least one sealed air chamber includes a wall including a material selected from heavy-weight vinyl, PVC coated fabric, PVC coated polyester, and PVC coated nylon.

The at least one sealed air chamber may include at least one inflation valve configured to receive an electronic pump to inflate the at least one sealed air chamber. In one or more embodiments, the at least one sealed air chamber includes at least one air release valve mechanism configured to maintain a set pressure within the at least one sealed air chamber. The set pressure may be, for example, between about 1 psi to about 3 psi.

The at least one sealed air chamber includes at least a first side support and a second side support, each side support including a support end and a base end. In one or more embodiments, the first side support and the second side support each include at least two support legs. The at least two support legs are coupled with each other by at least one crossbar and a top bar. In one or more embodiments, the support end of each of the first side support and the second side support is disposed on the top bar.

The at least one sealed air chamber further includes a main beam including a first end and a second end, the first end coupled with the support end of the first side support, and the second end coupled with the support end of the second side support. In one or more embodiments, the first side support and the second side support are each coupled with a main beam at an angle of at least about 90°.

The at least one sealed air chamber further includes a first plurality of connectors coupled with the base end of the first side support and a second plurality of connectors coupled with the base end of the second side support, where the first plurality of connectors and the second plurality of connectors are configured to detachably couple with a plurality of connectors disposed on a cold-air inflatable structure.

The at least one sealed air chamber is configured to support a weight applied to the main beam. In one or more embodiments, the main beam is further configured to couple with at least one weight-bearing attachment. The main beam may further includes at least one embedded structure configured to position the at least one weight-bearing attachment. The at least one weight-bearing attachment may be selected from climbing equipment, playground equipment, swinging equipment and sporting equipment. In one or more embodiments, the at least one sealed air chamber is configured to support a total weight of at least 500 pounds applied to the at least one weight-bearing attachment coupled with the one main beam.

In one or more embodiments, the at least one sealed air chamber includes at least one tubular wall with a diameter of at least about 12 inches. In one or more embodiments, the at least one sealed air chamber includes at least one tubular wall with a diameter of at least about 18 inches. In one or more embodiments, the at least one sealed air chamber includes at least one tubular wall with a diameter of at least about 36 inches.

In one or more embodiments, the sealed air support structure further includes a base configured to couple with the base end of the first side support and the second side support. The base may be configured to contain water.

In one or more embodiments, the sealed air support structure further includes at least one protective mattress configured to detachably couple with the base.

One or more embodiments of the invention enable a cold-air inflatable obstacle course structure. The cold-air inflatable obstacle course structure includes at least one cold-air inflatable structure configured to receive at least one inflatable blower.

The cold-air inflatable obstacle course structure further includes one or more obstacle course elements coupled with the at least one cold-air inflatable structure, where the one or more obstacle course elements are selected from one or more walls, hills, slides, barriers, ropes, tunnels, pillars and pits.

The cold-air inflatable obstacle course structure further includes at least one sealed air chamber. The at least one sealed air chamber includes a first side support including a plurality of support connectors configured to couple a first end of the at least one sealed air chamber to the at least one cold-air inflatable structure. The at least one sealed air chamber further includes a second side support including a plurality of support connectors configured to couple a second end of the at least one sealed air chamber to the at least one cold-air inflatable structure. The at least one sealed air chamber further includes a main beam including a first end and a second end, the first end coupled with the first side support, and the second end coupled with the second side support. The at least one sealed air chamber further includes at least one weight-bearing attachment configured to couple with the main beam, where the at least one weight-bearing attachment is selected from climbing equipment, playground equipment, swinging equipment and sporting equipment. The at least one sealed air chamber is configured to support a weight applied to the at least one weight-bearing attachment.

In one or more embodiments, the cold-air inflatable obstacle course structure includes at least two substantially similar obstacle courses running a length of the at least one structure, where the main beam of the at least one sealed air chamber is coupled with one weight-bearing attachment for each of the at least two substantially similar obstacle courses.

In one or more embodiments, the at least one sealed air chamber further includes a base configured to contain at least one of water and a protective mattress.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

An inflatable sealed air support device will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
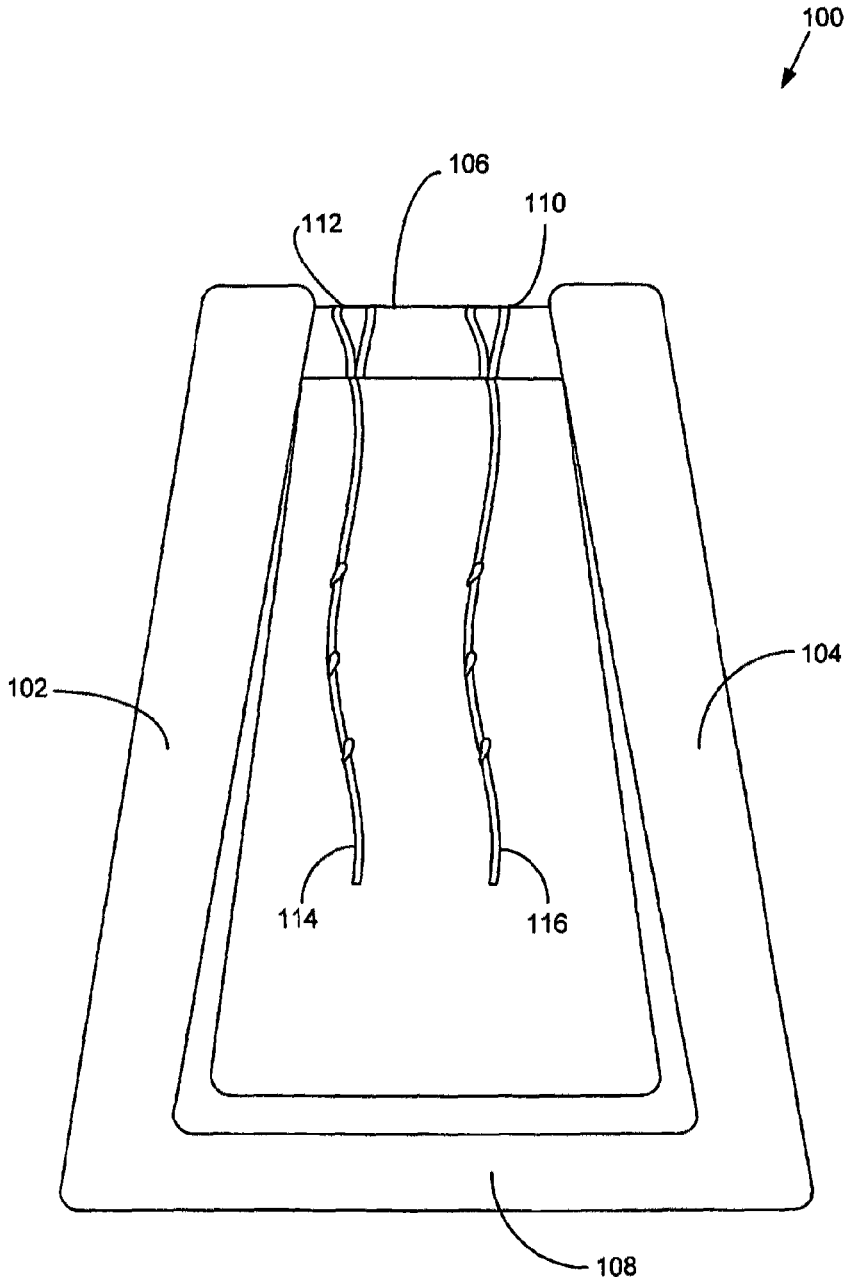
FIG. 1 illustrates a support structure in accordance with one or more embodiments of an inflatable sealed air support structure.

FIG. 1 illustrates a support structure in accordance with one or more embodiments of an inflatable sealed air support structure. Sealed air support structure 100 includes at least one sealed air chamber 108. In one or more embodiments, sealed air support structure 100 is constructed from multiple sealed air chambers 108. Sealed air support structure 100 is constructed with at least one sealed seam to prevent the escape of air or any other gas. For example, seams of sealed air support structure 100 may be heat sealed, hot-air welded, radiofrequency (RF) sealed, glued, or otherwise sealed using any other method. Sealed air support structure 100 may be constructed from heavyweight vinyl, PVC coated fabrics, PVC coated polyester, PVC coated nylon, or any other appropriate material to construct a sealed air chamber 108.

In one or more embodiments, the at least one sealed air chamber 108 includes at least one inflation valve configured to receive an electronic pump, pressurized gas, or any other device to inflate sealed air chamber 108. Sealed air chamber 108 may also further include at least one air release valve mechanism configured to maintain a set pressure within sealed air chamber 108. For example, in one or more embodiments, the set pressure is between about 1 psi two about 3 psi. In one or more embodiments, the set pressure is about 2 psi. In order more embodiments, the set pressure and the material may be selected based on the desired weight-bearing capacity of sealed air support structure 100.

Sealed air support structure 100 may include at least one tubular wall. The diameter of the at least one tubular wall may vary when sealed air support structure 100 has more than one tubular wall component. In one or more embodiments, a diameter of the at least one tubular wall is at least about 12 inches. The diameter of the at least one tubular wall may also be at least about 18 inches. The diameter of the at least one tubular wall may also be at least about 24 inches. One or more embodiments, a diameter of the at least one tubular wall is at least about 36 inches. The diameter of the at least one tubular wall may be selected based on the desired weight-bearing capacity of sealed air support structure 100.

Sealed air support structure 100 further includes side supports 102-104. In one or more embodiments, sealed air support structure 100 includes a first side support and a second side support disposed on each side of main beam 106. In one or more embodiments, main beam 106 includes a first end coupled with a first side support structure 102 and a second end coupled with a second support structure 104. In one or more embodiments, main beam 106 is constructed from heavyweight vinyl, PVC coated fabrics, PVC coated polyester, PVC coated nylon, or any other appropriate material to construct a sealed air chamber. Alternatively, main beam 106 may include at least one solid structure rather than an inflatable structure.

In one or more embodiments (not shown), side support structures 102-104 are arranged in a semi-circular manner around a center top portion that replaces main beam 106.

Sealed air support structure 100 is configured to support a weight applied to main beam 106. For example, the weight may be applied directly by a person, such as by a person grabbing, hanging, leaning, or otherwise applying force to main beam 106.

In one or more embodiments, main beam 106 is further configured to couple with at least one weight-bearing attachment 114-116, and sealed air support structure 100 is configured to support a weight applied to the at least one weight-bearing attachment 114-116. Weight-bearing attachments 114-116 may include climbing equipment, playground equipment, swinging equipment, sporting equipment, as well as any other equipment suitable for attaching to main beam 106. Weight-bearing attachments 114-116 may be coupled with main beam 106 by wrapping, tying, harnessing, or any other method suitable for attaching weight-bearing attachments 114-116 securely to main beam 106.

Figure 2:
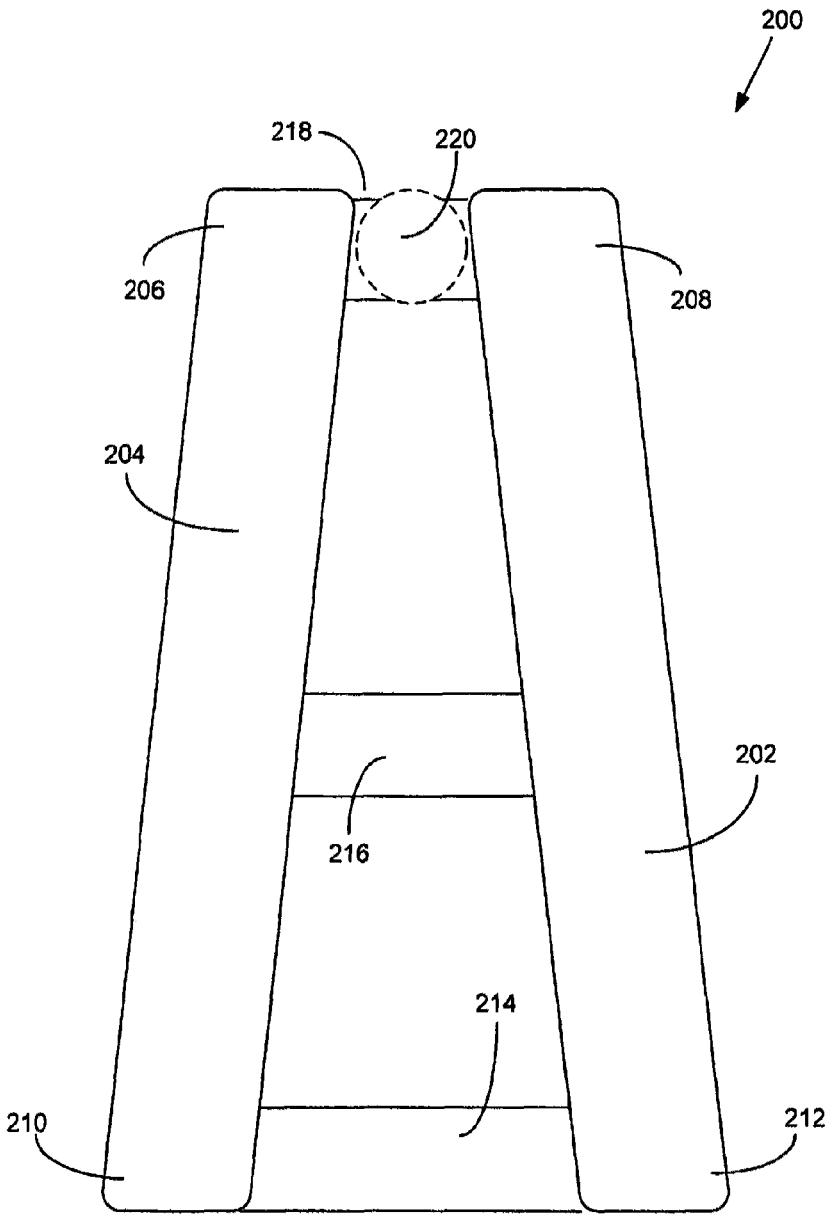
FIG. 2 illustrates a side view of an exemplary side support in accordance with one or more embodiments of an inflatable sealed air support structure.

FIG. 2 illustrates a side view of an exemplary side support in accordance with one or more embodiments of an inflatable sealed air support structure. Side support 200 includes support legs 202-204. Although two support legs are shown, one or more embodiments of side support 200 may include more than two support legs. Support legs 202-204 each include support end 206-208 and base end 210-212.

In one or more embodiments, support legs 202-204 are coupled with each other by at least one crossbar 214-216 and top bar 218. In one or more embodiments, main beam 220 is coupled with side support 200 at top bar 218.

Figure 3B:
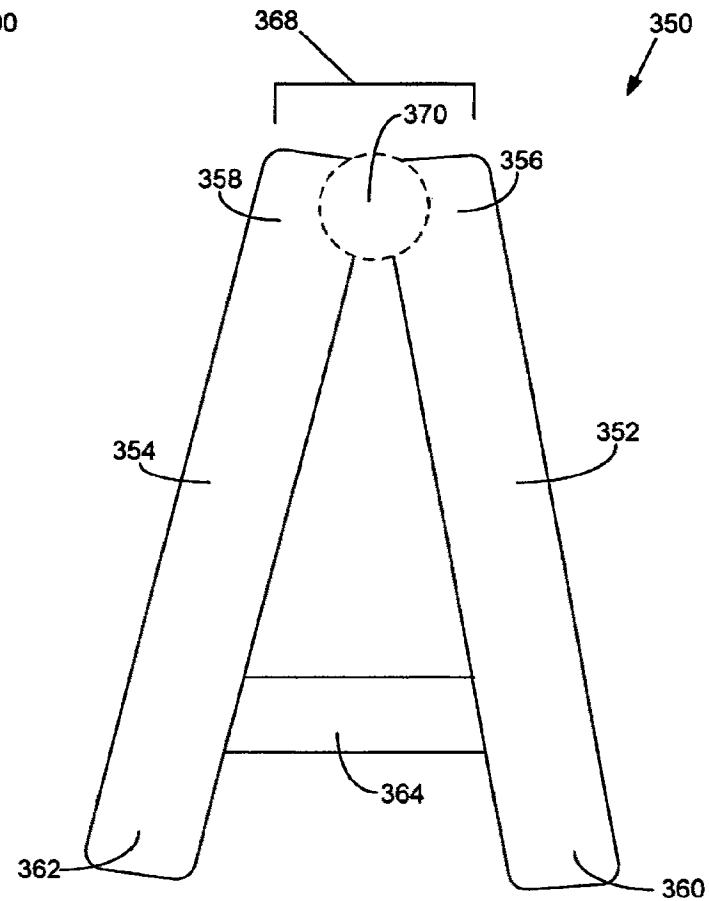
FIGS. 3A-B illustrate a side view of exemplary side supports in accordance with one or more embodiments of an inflatable sealed air support structure.
Figure 3A:
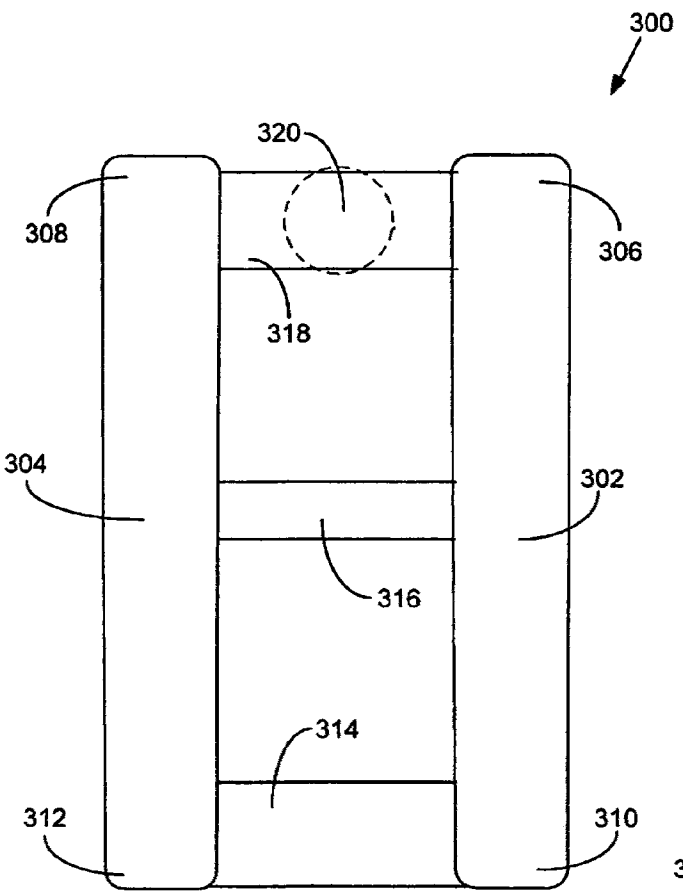

FIGS. 3A-B illustrate a side view of exemplary side supports in accordance with one or more embodiments of an inflatable sealed air support structure. FIG. 3A illustrates an exemplary side support in accordance with one or more embodiments of an inflatable sealed air support structure. Side support 300 includes support legs 302-304. Although two support legs are shown, one or more embodiments of side support 300 may include more than two support legs. Support legs 302-304 each include support end 306-308 and base end 310-312.

In one or more embodiments, support legs 302-304 are coupled with each other by at least one crossbar 314-316 and top bar 318. In one or more embodiments, support ends 306-308 couple with top bar 318 at about a 90° angle. In one or more embodiments, main beam 320 is coupled with side support 300 at top bar 318.

FIG. 3B illustrates an exemplary side support in accordance with one or more embodiments of an inflatable sealed air support structure. Side support 350 includes support legs 352-354. Although two support legs are shown, one or more embodiments of side support 350 may include more than two support legs. Support legs 352-354 each include support end 356-358 and base end 360-362.

In one or more embodiments, support legs 352-354 are coupled with each other by at least one crossbar 364 and top bar 368. In one or more embodiments, support ends 356-358 couple with top bar 318 at greater than a 90° angle. In one or more embodiments, main beam 320 is coupled with side support 300 at top bar 368. In one or more embodiments, top bar 368 is a portion of side support 350 formed by support ends 356-358.

In one or more embodiments, at least one crossbar 314 is coupled to support ends 310-312, and is located at the bottom of side support 300. Alternatively, the lowest crossbar 364 may be coupled with support legs 352-354 higher than base ends 360-362.

Figure 4:
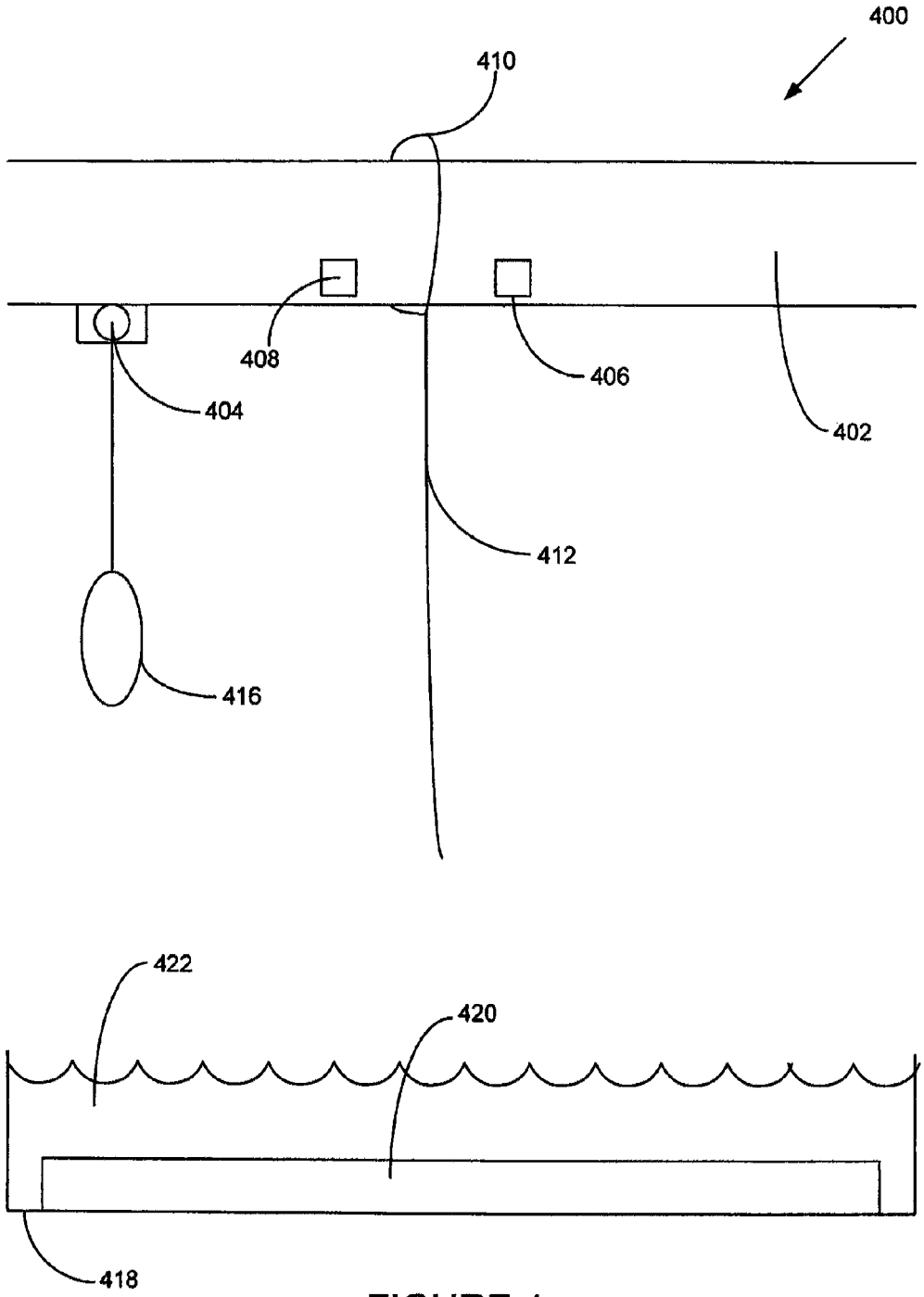
FIG. 4 illustrates a partial front view of a sealed air support structure in accordance with one or more embodiments of an inflatable sealed air support structure.

FIG. 4 illustrates a partial front view of a sealed air support structure in accordance with one or more embodiments of an inflatable sealed air support structure. Sealed air support structure 400 includes main beam 402. Main beam 402 may include one or more embedded structures 404-408. Embedded structures 404-408 are configured to position at least one weight-bearing attachment 410-416. The at least one weight-bearing attachment is selected from climbing equipment, playground equipment, swinging equipment and sporting equipment, where the at least one sealed air chamber is configured to support a weight applied to the at least one weight-bearing attachment.

Sealed air support structure 400 further includes base 418. Base 418 is configured to coupled with the base end of at least one side support. In one or more embodiments, base 418 is configured to contain water 422. Water 422 is positioned below main beam 402, including weight-bearing attachments 410-416. Base 418 may be reinforced, such as by plastic, waterproofing, PVC, or any other material suitable for containing water 422.

It is one or more embodiments, base 418 is configured to detachably coupled with at least one protective mattress 420. Protective mattress 420 is positioned below main beam 402. Protective mattress 420 is positioned below main beam 402, including weight-bearing attachments 410-416. In one or more embodiments, protective mattress 420 attaches to base 418 by straps, class, fasteners, or any other attachment suitable for detachably coupling protective mattress 420 to base 418.

Figure 5A:
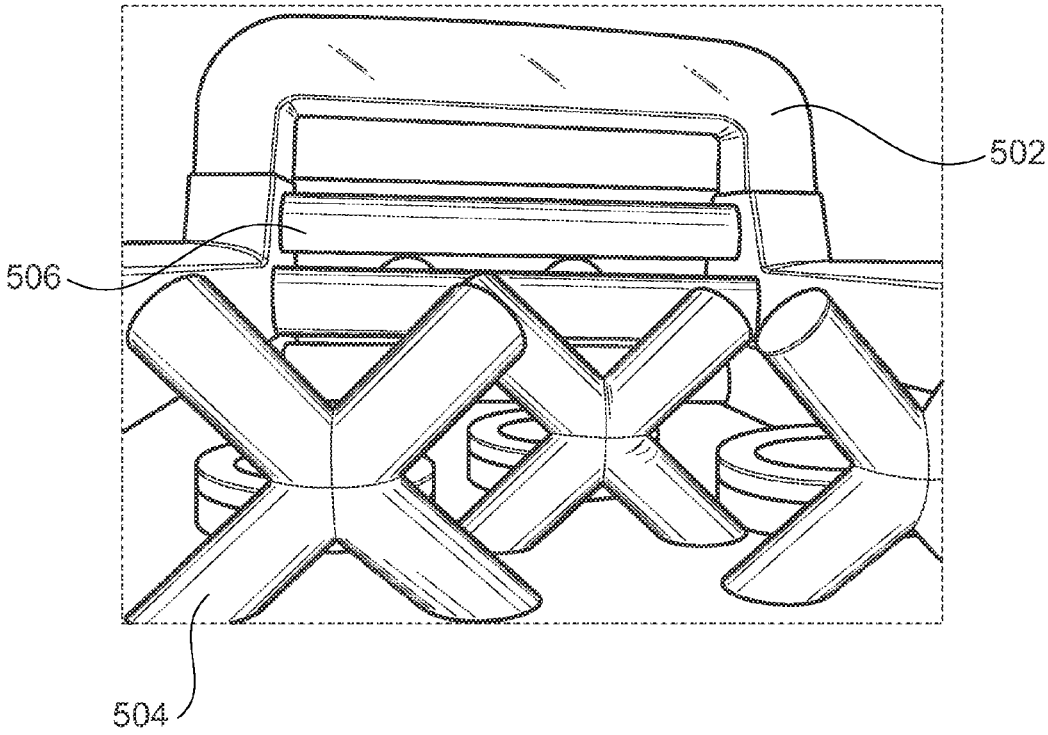
FIGS. 5A-5B illustrate exemplary obstacles in a cold-air inflatable obstacle course structure including an inflatable sealed air support structure in accordance with one or more embodiments of an inflatable sealed air support structure.
Figure 5B:
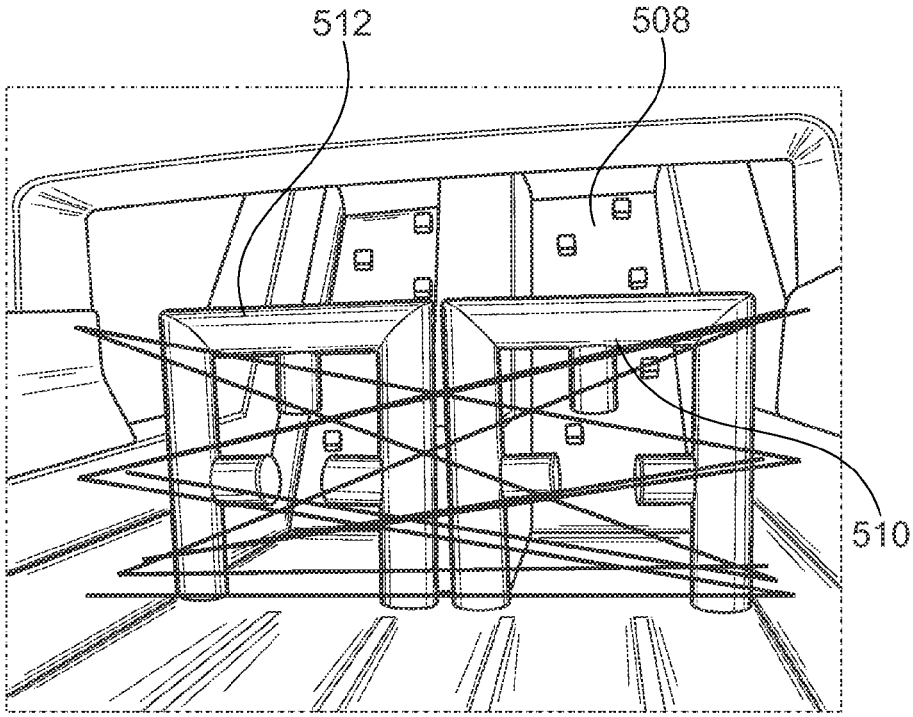

FIGS. 5A-5B illustrate exemplary obstacles in a cold-air inflatable obstacle course structure including an inflatable sealed air support structure in accordance with one or more embodiments of an inflatable sealed air support structure. Obstacles 502-512 may be selected from one or more walls, hills, slides, barriers, ropes, tunnels, pillars, pits, and any other barriers suitable for including an obstacle course of a cold-air inflatable structure.

Figure 6:
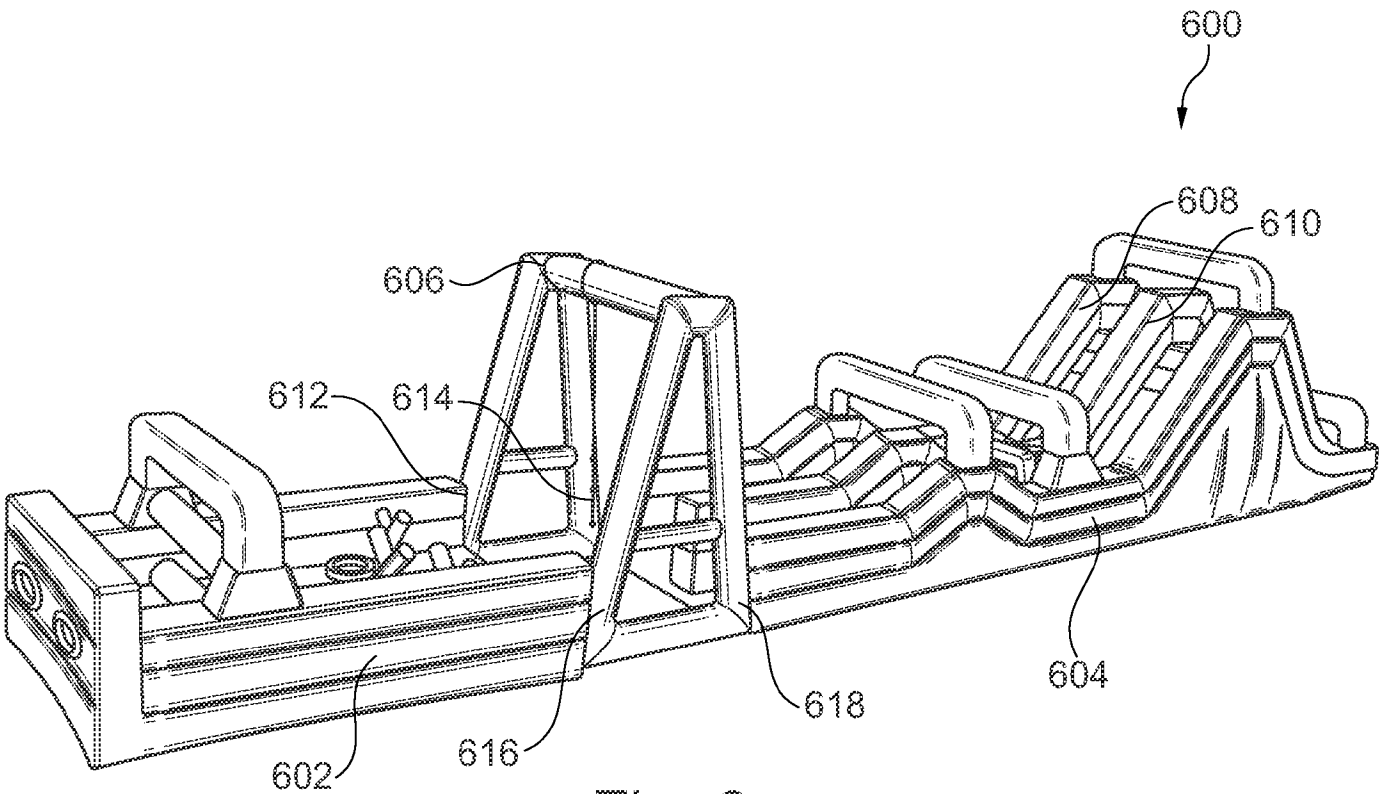
FIG. 6 illustrates a perspective view of a cold-air inflatable obstacle course structure including an inflatable sealed air support structure in accordance with one or more embodiments of an inflatable sealed air support structure.

FIG. 6 illustrates a perspective view of a cold-air inflatable obstacle course structure including an inflatable sealed air support structure in accordance with one or more embodiments of an inflatable sealed air support structure. Cold-air inflatable obstacle course structure 600 includes at least one cold-air inflatable structure 602-604. Cold-air inflatable structures 602-604 may include at least one obstacle course element, such as obstacles 502-512.

Cold-air inflatable obstacle course structure 600 further includes at least one sealed air chamber 606. Sealed air chamber 606 is coupled with at least one of cold-air inflatable structures 602-604. Sealed air chamber 606 may be integrated in cold-air inflatable obstacle course structure 600 to provide obstacles that require weight-bearing support, such as climbing, swinging, pulling, or any other weight-bearing activity.

In one or more embodiments, sealed air chamber 606 is detachably coupled with at least one of cold-air inflatable structures 602-604. For example, sealed air chamber 606 may be coupled at support legs 612-618. In one or more embodiments, sealed air chamber 606 is configured to detachably couple with at least one of cold-air inflatable structures 602-604. For example, a first plurality of connectors coupled with a base end of a side support, such as a support leg 612-618, may be configured to coupled with a plurality of connectors disposed on a cold-air inflatable structure, such as cold-air inflatable structures 602-604. The connectors may include grommets, clasps, male and female fasteners, zippers, or any other fasteners suitable for detachably coupling sealed air chamber 606 two at least one of cold-air inflatable structures 602-604.

In one or more embodiments, cold-air inflatable obstacle course structure 600 includes at least two substantially similar obstacle courses 608-610 running a length of cold-air inflatable obstacle course structure 600, allowing two or more participants to simultaneously complete obstacle courses 608-610, such as in a race. If one or more embodiments, a weight-bearing attachment is provided on main beam of sealed air chamber 606 for each obstacle course 608-610.

While the invention herein disclosed has been described by means of specific embodiments and applications thereof, numerous modifications and variations could be made thereto by those skilled in the art without departing from the scope of the invention set forth in the claims.

What is claimed is:

1. A sealed air support structure comprising:

at least one sealed air chamber comprising at least one sealed seam, said at least one sealed air chamber further comprising:

at least a first side support and a second side support, each side support comprising a support end and a base end;

a main beam comprising a first end and a second end, said first end coupled with said support end of said first side support, and said second end coupled with said support end of said second side support; and a first plurality of connectors coupled with said base end of said first side support and a second plurality of connectors coupled with said base end of said second side support, wherein said first plurality of connectors and said second plurality of connectors are configured to detachably couple with a plurality of connectors disposed on a cold-air inflatable structure, wherein said at least one sealed air chamber is configured to support a weight applied to said main beam.

2. The sealed air support structure of claim 1, wherein said at least one sealed air chamber comprises a wall comprising a material selected from heavy-weight vinyl, PVC coated fabric, PVC coated polyester, and PVC coated nylon.

3. The sealed air support structure of claim 1, further comprising at least one inflation valve configured to receive an electronic pump to inflate said at least one sealed air chamber.

4. The sealed air support structure of claim 1, further comprising at least one air release valve mechanism configured to maintain a set pressure within said at least one sealed air chamber.

5. The sealed air support structure of claim 4, wherein said set pressure is between about 1 psi to about 3 psi.

6. The sealed air support structure of claim 1, wherein said at least one sealed air chamber comprises at least one tubular wall with a diameter of at least about 12 inches.

7. The sealed air support structure of claim 1, wherein said at least one sealed air chamber comprises at least one tubular wall with a diameter of at least about 18 inches.

8. The sealed air support structure of claim 1, wherein said at least one sealed air chamber comprises at least one tubular wall with a diameter of at least about 36 inches.

9. The sealed air support structure of claim 1, wherein said main beam is further configured to couple with at least one weight-bearing attachment.

10. The sealed air support structure of claim 9, wherein said main beam further comprises at least one embedded structure configured to position said at least one weight-bearing attachment.

11. The sealed air support structure of claim 9, wherein said at least one weight-bearing attachment is selected from climbing equipment, playground equipment, swinging equipment and sporting equipment.

12. The sealed air support structure of claim 1, wherein said at least one sealed air chamber is configured to support a total weight of at least 500 pounds applied to said at least one weight-bearing attachment coupled with said one main beam.

13. The sealed air support structure of claim 1, further comprising a base configured to couple with said base end of said first side support and said second side support.

14. The sealed air support structure of claim 13, wherein said base is configured to contain water.

15. The sealed air support structure of claim 13, further comprising at least one protective mattress configured to detachably couple with said base.

16. The sealed air support structure of claim 1, wherein said first side support and said second side support are each coupled with said main beam at an angle of at least about 90°.

17. The sealed air support structure of claim 1, wherein said first side support and said second side support each comprise at least two support legs, said at least two support legs coupled with each other by at least one crossbar and a top bar, wherein said support end of each of said first side support and said second side support is disposed on said top bar.

18. A cold-air inflatable obstacle course structure comprising:

at least one cold-air inflatable structure configured to receive at least one inflatable blower;

one or more obstacle course elements coupled with said at least one cold-air inflatable structure, wherein said one or more obstacle course elements are selected from one or more walls, hills, slides, barriers, ropes, tunnels, pillars and pits;

at least one sealed air chamber comprising:

a first side support comprising a plurality of support connectors configured to couple a first end of said at least one sealed air chamber to said at least one cold-air inflatable structure;

a second side support comprising a plurality of support connectors configured to couple a second end of said at least one sealed air chamber to said at least one cold-air inflatable structure;

a main beam comprising a first end and a second end, said first end coupled with said first side support, and said second end coupled with said second side support; and at least one weight-bearing attachment configured to couple with said main beam, wherein said at least one weight-bearing attachment is selected from climbing equipment, playground equipment, swinging equipment and sporting equipment, wherein said at least one sealed air chamber is configured to support a weight applied to said at least one weight-bearing attachment.

19. The cold-air inflatable obstacle course structure of claim 18, comprising at least two substantially similar obstacle courses running a length of said at least one cold-air inflatable structure, wherein said main beam of said at least one sealed air chamber is coupled with one weight-bearing attachment for each of said at least two substantially similar obstacle courses.

20. The cold-air inflatable obstacle course structure of claim 18, wherein said at least one sealed air chamber further comprises a base configured to contain at least one of water and a protective mattress.

* * * * *